US005778607A

United States Patent [19]

Edwards

[11] Patent Number: 5,778,607

[45] Date of Patent: Jul. 14, 1998

[54] PORTABLE SMOKER'S BOOTH

[76] Inventor: Benjamin J. Edwards, 3022 Lindenwood, Dearborn, Mich. 48120

[21] Appl. No.: 680,247

[22] Filed: Jul. 11, 1996

[51] Int. Cl.[6] ..... E04H 1/00

[52] U.S. Cl. ..... 52/79.1; 52/36.4; 454/230

[58] Field of Search ..... 52/79.1, 27, 63, 52/79.7, 36.1, 36.2, 36.4, 27.5; 459/230, 233, 341; 55/210, 274

[56] References Cited

U.S. PATENT DOCUMENTS

| | | | |
|---|---|---|---|
| 1,929,776 | 10/1933 | Faber | 52/27.5 X |
| 2,248,810 | 7/1941 | Corso | 52/27.5 X |
| 2,371,968 | 3/1945 | Lum | 52/27.5 X |
| 3,377,080 | 4/1968 | Bartley et al. | 52/27.5 X |
| 4,883,512 | 11/1989 | Griffis . | |
| 5,010,777 | 4/1991 | Yehl et al. . | |
| 5,064,457 | 11/1991 | Weber . | |
| 5,074,897 | 12/1991 | Sikich . | |
| 5,181,883 | 1/1993 | Hofstra et al. . | |
| 5,407,389 | 4/1995 | Poblete et al. . | |
| 5,472,466 | 12/1995 | Oler . | |
| 5,537,787 | 7/1996 | Abraham | 52/79.1 |

*Primary Examiner*—Carl D. Friedman
*Assistant Examiner*—Beth Aubrey
*Attorney, Agent, or Firm*—Fildes & Outland, P.C.

[57] ABSTRACT

A smoker's booth, for use within an enclosed area, including sidewalls having a door providing access to a single user compartment, wherein the sidewalls define upper and lower open ends. The lower end is closed by a base panel supporting the sidewalls, while the upper end is closed by a modular cap assembly, adapted for treating tobacco smoke-laden air drawn upwardly from the closed compartment. The modular cap assembly, which includes a closed space divided into a plurality of chambers, provides at least one plenum chamber and an electrical equipment chamber. An air treating unit is located in the plenum chamber, intermediate intake and return air vent openings communicating with the compartment. A blower draws tobacco smoke-laden air upwardly from the compartment, through the intake vent opening and plenum chamber, and returns only treated air to the compartment, via its return vent. As the compartment air is self contained, the booth obviates exchange of ambient air with tobacco smoke-laden air during its operation. A second embodiment provides an adjustable damper in the plenum chamber, allowing all or a selected portion of the treated air to be exhausted to the ambient, while an ambient air intake louver, in the booth sidewall, draws an amount of ambient "make-up" air into the compartment equal to the amount of exhausted treated air.

27 Claims, 12 Drawing Sheets

PORTABLE SMOKER'S BOOTH

FIELD OF THE INVENTION

This invention relates to enclosures for cleaning contaminated air and, more particularly, to a freestanding smoker's booth incorporating an air circulating arrangement for filtering tobacco smoke-laden air.

BACKGROUND OF THE INVENTION

Various enclosures for venting and filtering tobacco smoke-laden air have been proposed. One example is a smoker's sealed enclosure having a plurality of ambient air intake vent apertures and an exhaust vent aperture located on an outside wall, wherein tobacco smoke particles in the air are removed and retained prior to the air being released outside the enclosure. A fan is provided for generating a pressure differential across the vent apertures, thereby creating a negative air pressure in the enclosure. Another proposal involves a walled booth, for one or more smokers, having an entrance which is permanently open to the atmosphere. Upon a sensor detecting the presence of a smoker in the open booth, a control circuit activates means for venting filtered tobacco smoke-laden air from the booth and away from the vicinity proximate to the booth.

Neither of the above proposals are suitable for use in enclosed areas, such as public buildings, offices, restaurants, industrial locations and the like, for a variety of reasons. The above enclosure proposals are not sized and configured so that they can accommodate only one smoker at a time. By not isolating a smoker from other smokers, the user is subjected to secondary tobacco smoke, including the user's smoke, prior to such smoke being exhausted or filtered. The above enclosures, when used in an occupied setting, expose others in the area surrounding such enclosures to secondary or secondhand-smoke. Further, as the above proposals exhaust filtered air to the surrounding ambient air, the failure of an enclosure filtration system would not be readily apparent to a user.

SUMMARY OF THE INVENTION

Accordingly, it is a feature of one embodiment of the present invention to fulfill the above discussed needs by providing a freestanding smoker's booth, for use within an enclosed area, defining a user compartment adapted for closure during operation of a circulating air system, which system filters tobacco smoke-laden compartment air without any exchange of compartment air with surrounding environmental air, i.e. ambient air.

It is another feature of the present invention to provide a portable smoker's booth, including a user compartment that is sized and configured to accommodate one smoker at a time, thereby discouraging extended smoking periods. The compartment is defined by sidewall means having a doorway closed by a door, wherein the compartment lower open end is closed by a support base and its upper open end is closed by a modular air filtration cap assembly.

It is still another feature of the present invention wherein the modular cap assembly includes a cap space divided into a plurality of chambers, with at least one chamber being a plenum chamber enclosing an air filtration unit. The filtration unit includes an electrostatic filter located in the one plenum chamber, intermediate an air intake vent opening and an air exhaust vent opening, and a blower in the plenum chamber operative, upon the compartment door being closed, to cause a current of tobacco smoke-laden compartment air to flow upwardly through the intake vent openings and the filter unit, thereby returning the filtered air current to the compartment via the exhaust vent openings.

It is a further feature of the invention wherein the modular cap assembly is housed by a modular cap structure, including a ceiling panel, surrounded by peripheral wallboards supporting an overlying roof panel, defining a closed cap space therebetween. Partition members upstanding from the ceiling panel divide the cap space into first and second plenum chambers, wherein each plenum chamber encloses an air treating unit, including an electric powered blower, located intermediate an air intake vent opening and an air exhaust vent opening. Each blower provides an upward air current from the tobacco smoke-laden compartment air, which current flows upwardly through its associated intake vent opening and air treating unit, wherein each filtered air current is returned to the compartment through its associated plenum chamber exhaust vent opening.

It is yet another feature of the present invention to provide a smoker's booth, as set forth above, wherein the first plenum chamber has an electrostatic filtration unit mounted therein, and the second plenum chamber has an ionizing air purification unit mounted therein.

It is another feature of the present invention to provide the above described single user smoker's booth, in the form of a portable booth, defining a rectangular cross section sized with a width dimension of the order of two-feet, eight inches, a depth dimension of the order of three-feet, and a height dimension of the order of seven feet, whereby the booth is adapted for ready installation in an enclosed area possessing a minimum doorway width dimension of three feet and a minimum ceiling height of eight feet.

It is yet another feature of the present invention to provide a self-contained smoker's booth incorporating an electrical wiring circuit, requiring only one external electrical cord and grounded plug connection to a duplex receptacle wall outlet delivering 120 volt line service. The booth electrical circuit includes a low-voltage circuit portion wired to a permanent magnet proximity switch mounted on the booth and a ferrous metal switch armature mounted on the compartment door. Upon the user closing the booth door, the armature is moved into sensing range of the switch magnet, causing the switch to close the contacts of a control unit low-voltage output relay. A step-down transformer of the control unit provides line voltage power to one circuit portion for operating one or more modular cap air treating units, together with their associated blower motors, and low-voltage power circuit portion for operating a booth interior convenience light fixture and exterior occupancy light fixture. The booth circuit includes a timer arrangement wherein, upon a smoker opening the door and exiting the booth, the magnet proximity switch opens, removing power from a first electrostatic air filtration unit, while allowing a second ionizing air purification unit to remain in operation for an additional time interval, thereby removing any latent smoke odors, and the like from the booth.

It is a still further feature of the invention wherein a modular cap box-shaped housing of the assembly includes a cap space defining a plurality of enclosed chambers, wherein at least one of the chambers is an air treatment plenum chamber. The modular box-shaped cap housing serves as a torque-box, greatly increasing the booth's structural rigidity, thereby insuring a long service life for the portable booth.

Another feature of the invention allows the modular air treating cap assembly to be used in combination with various booth designs such as, for example, a booth having a width of about two-feet eight inches for passage through standard three-foot doorways, an enlarged smoker's booth for wheelchair users, adapted for ready disassembly, and an integral structural plastic smoker's booth for industrial settings, adapted for high-pressure washing upon the modular cap assembly being removed.

Still another feature of the invention is to provide a modular smoke ventilation cap assembly that divides the modular cap space into a plurality of chambers to provide an enclosed electrical equipment chamber for isolating the control unit output relay, line transformer, and the like, from the low-voltage circuit portion of the booth.

A final feature of the first embodiment of the invention is to provide a removable access roof panel for the booth modular cap assembly, thereby allowing ready servicing and maintenance of the cap electrical equipment chamber, one or more air filtration plenum chambers, booth occupied light fixture chamber, etc.

A second embodiment of the invention, shown in FIGS. 9–11, provides a freestanding smoker's booth, similar to the first embodiment, wherein the booth includes a plenum chamber enclosing an air treating and blower unit intermediate an intake air vent opening and an adjustable damper, with the plenum chamber air intake opening in communication with the user's compartment. An air intake louver opening, in a sidewall of the compartment, and an exhaust air vent opening in the plenum chamber are both in communication with the ambient air of an enclosed area surrounding the booth. The adjustable damper is positioned in the plenum chamber intermediate the plenum chamber exhaust air vent opening and a plenum chamber return air vent opening in communication with the booth compartment. Thus, the adjustable damper is adapted to direct all the treated air flow from the blower either to the ambient air, via the chamber exhaust air vent opening, or to the booth compartment, via the return air vent opening. It will be appreciated that, in the latter case, the second embodiment air treating system functions in the selfcontained manner as described for the first embodiment.

In addition, the damper may be adjusted to one of a plurality of divided treated air flow settings, wherein a selected percentage of the treated air flow is exhausted to the ambient air, through the plenum chamber exhaust air vent opening. The remaining treated air flow, which is returned to the booth compartment through the plenum chamber return air vent opening, is mixed with an amount of "make-up" ambient air drawn into the compartment through its intake louver opening. It will be noted that this the amount of compartment "make-up" ambient air is equal to the selected percentage of plenum chamber treated air flow exhausted to the ambient air.

These and other features and advantages of the invention will be more fully understood from the following detailed description of the invention taken together with the accompanying drawings.

DETAILED DESCRIPTION OF THE INVENTION

Figure 1:
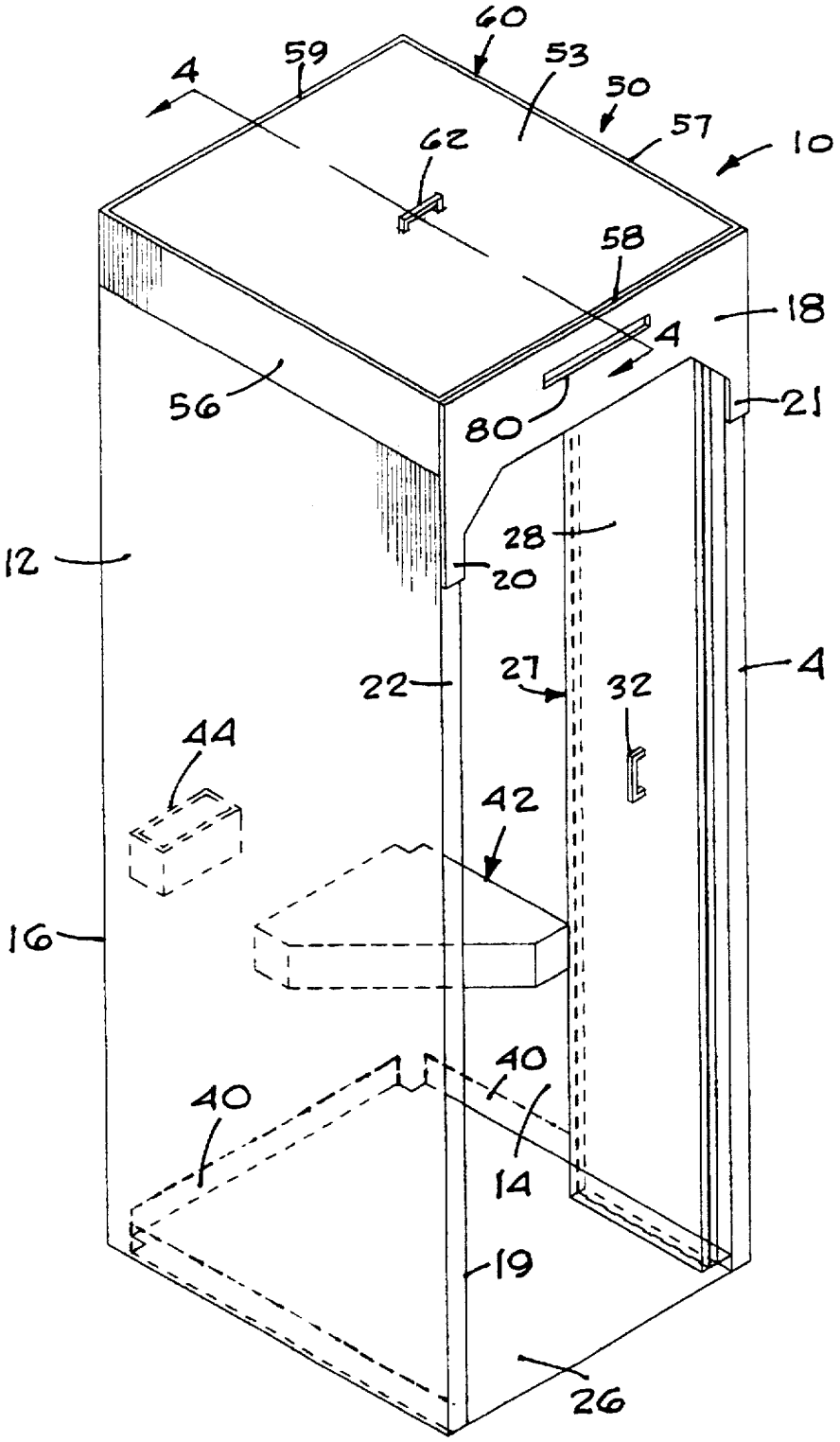
FIG. 1 is a perspective view of the smoker's booth of the present invention with the bifold door shown in its open position.
Figure 2A:
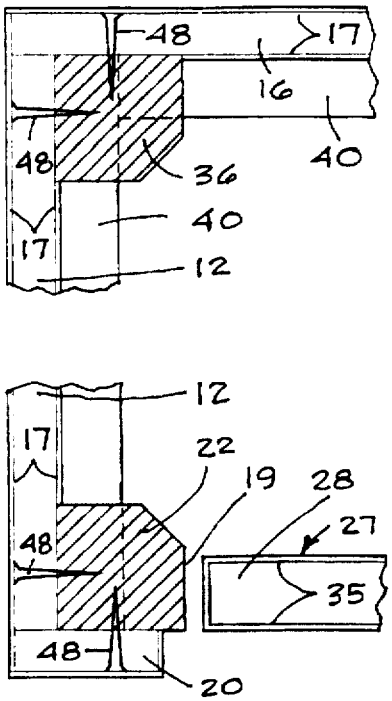
FIG. 2A is an enlarged, fragmentary view of the booth left side sidewall panel, shown in FIG. 2, together with adjacent portions of the back sidewall panel and front bifold door, with the door shown in its closed position.
Figure 4:
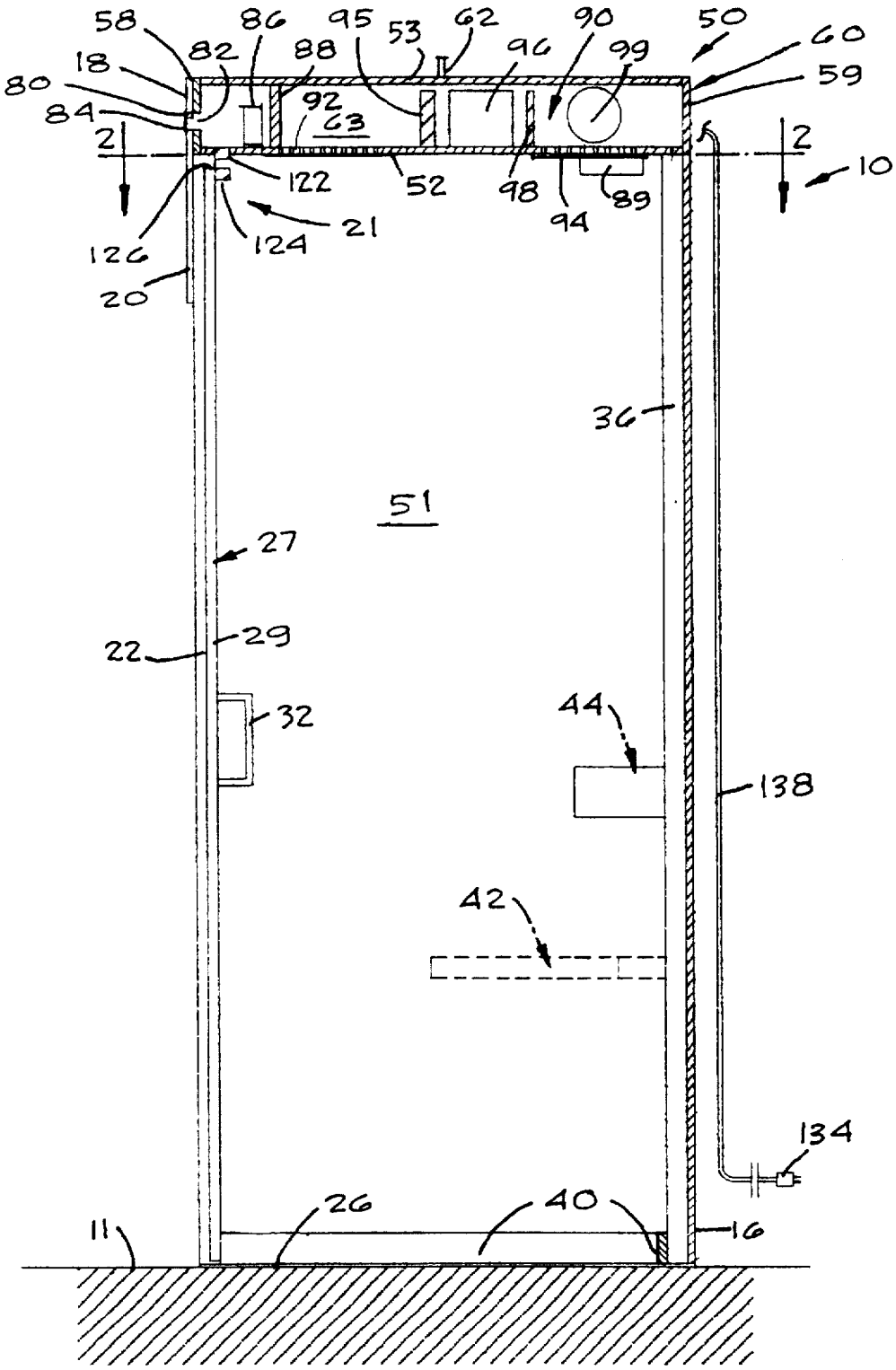
FIG. 4 is a vertical cross sectional view, taken substantially on the line 4—4 of FIG. 1, with the bifold door shown in its closed position.

Referring now to the drawings in detail, numeral 10 in FIG. 1 generally indicates a smoker's booth, adapted for use by one smoker at a time, embodying the principles and concepts of the present invention. The booth 10 is shown in FIG. 4 supported in a free standing manner on a floor 11 of a confined or indoor area, such as a public building, office, restaurant, industrial building, etc. The booth includes right 12, left 14, and back 16 panel sidewalls, together with a front upper facia panel 18 partially defining a front doorway 19. As seen in FIG. 2A of the disclosed embodiment, the booth sidewalls 12, 14, and 16 are of half-inch particulate board material covered on both sides with thick plastic laminate 17.

Figure 3:
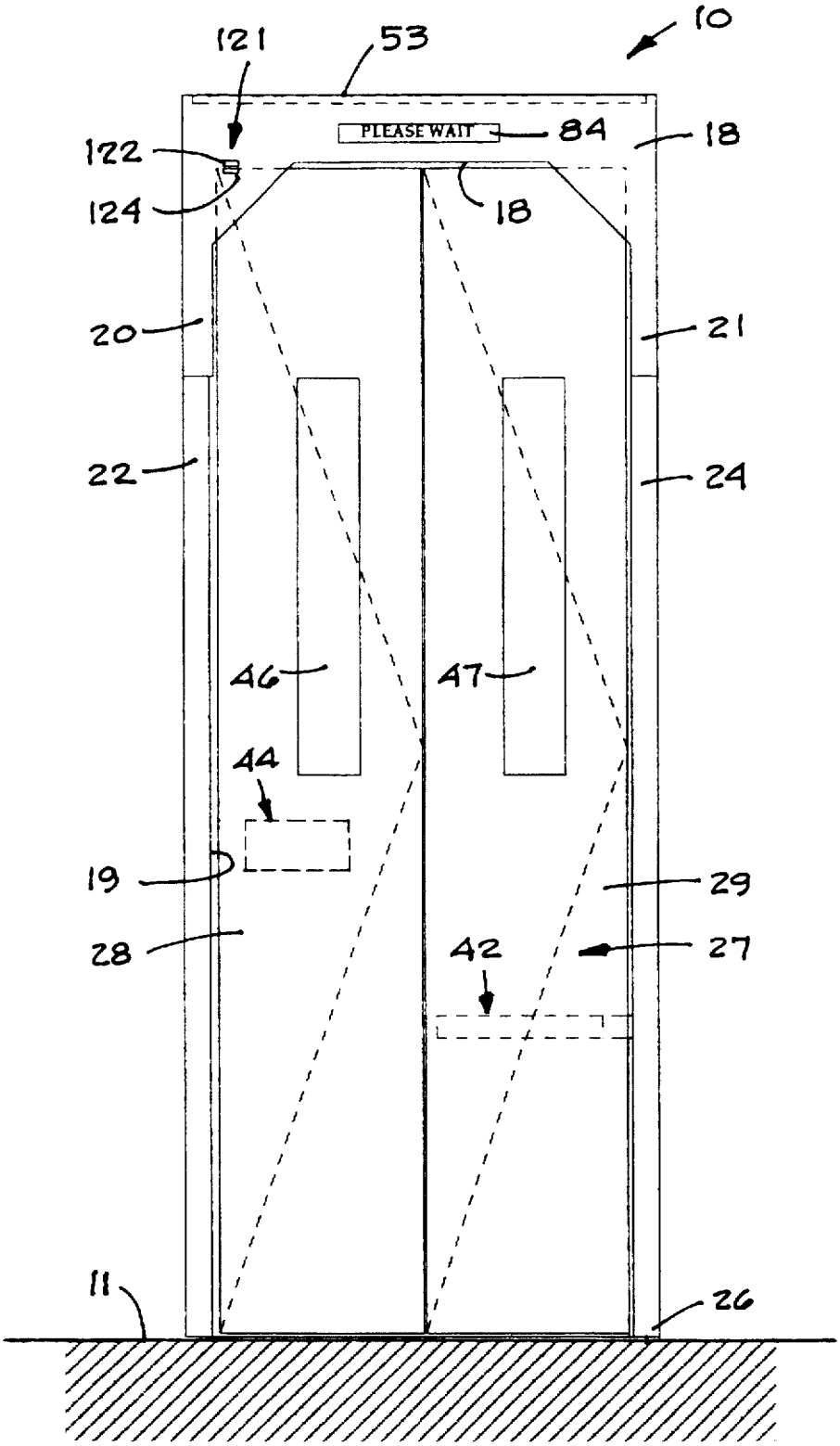
FIG. 3 is a front elevational view of the booth with the bifold door shown in its closed position.

The booth 10 is rectangular in horizontal section, having a width of the order of two feet-eight inches and a length of the order of three feet, allowing the booth clearance to pass through a three foot wide entrance of a building, room, etc., without any modifications to the entrance or the booth. The overall height of the booth 10 is about seven and a half feet, enabling the booth to be "tipped up" or righted within a room having a minimum ceiling height of eight feet. FIG. 3 shows the facia panel 18 including a pair of opposed left 20 and right 21 downstanding legs secured, in an overlying manner, to an associated one of a pair of left 22 and right 24 front corner framing posts.

As seen in FIG. 3, the facia panel 18 and its downstanding legs 20, 21 define, together with front framing posts 22, 24, and a support base 26, the front doorway 19, adapted to be closed by suitable door means. In the disclosed embodiment, the doorway 19 is shown closed, in a non-sealed manner, by a bifold door, generally indicated at 27, having guide rollers, not shown, slidably supported in a conventional manner on an upper track, concealed by the facia panel, extending along the top of the doorway. It will be noted that the present invention contemplates other types of doors being used to close the doorway 19. For example, a single door or a double-door could be used in place of the bifold door 27 without departing from the scope of applicant's invention.

Figure 2:
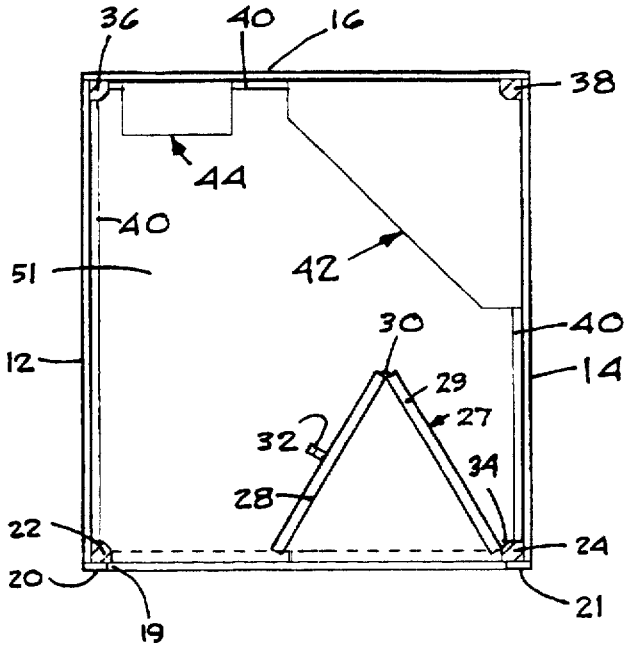
FIG. 2 is a horizontal cross sectional view, taken substantially on the line 2—2 of FIG. 4, with the bifold door shown in a partially open position.

The bifold door 27 is shown in FIG. 2 including left 28 and right 29 panel sections, having their opposed vertical edges hinged together, in a partially folded manner, by a continuous center piano hinge 30. An operating handle 32 is secured to an interior surface of the left panel section 28, while the right panel section 29 has its opposite vertical edge hinged to an associated right corner post 24 by a continuous piano hinge 34. In the disclosed embodiment, the door panel sections are made of three-quarter inch plywood, with each section having its surfaces covered with plastic laminate, as shown at 35 in FIG. 2A.

It will be noted that left 36 and right 38 rear corner framing posts, together with the front corner posts 22, 24, are each made from one and one-half inch square hardwood. Each corner post is suitably secured at its lower end to the base 26 by recessed screws, not shown. In the preferred form, the base panel is a one-quarter inch thick, waffled aluminum floor plate, providing a "bottom heavy", non-combustible base. A bottom hardwood frame includes side and back hardwood base board frame members, shown at 40 in FIGS. 1 and 2, which are secured along a lower interior portion of associated sidewalls 12, 14 and 16. The base board members 40 are lap-jointed into the lower end of the pillars and suitably secured, as by adhesive bonding and screws, indicated by left side front 22 and rear 36 pillars in FIG. 2A.

In FIGS. 1 and 2, a single triangular-shaped seat 42 is shown suitably supported as by screws, not shown, at the interior rear corner juncture of right sidewall panel 14 and back sidewall panel 16. A stainless steel disposal device 44 for ashes, residues, etc., is suitably mounted on the interior of back sidewall panel 16, at a location adjacent the corner juncture of the back 16 and left 12 sidewall panels. It will be noted in FIG. 3 that windows 46 and 47, preferably of outward viewing tempered, one way glass, are provided for each elongated rectangular opening in bifold door panel sections 28 and 29, respectively. As seen in FIG. 2A, the left 12, right 14, and back 16 sidewall panels are secured to their associated upright framing posts by screws 48.

Figure 5:
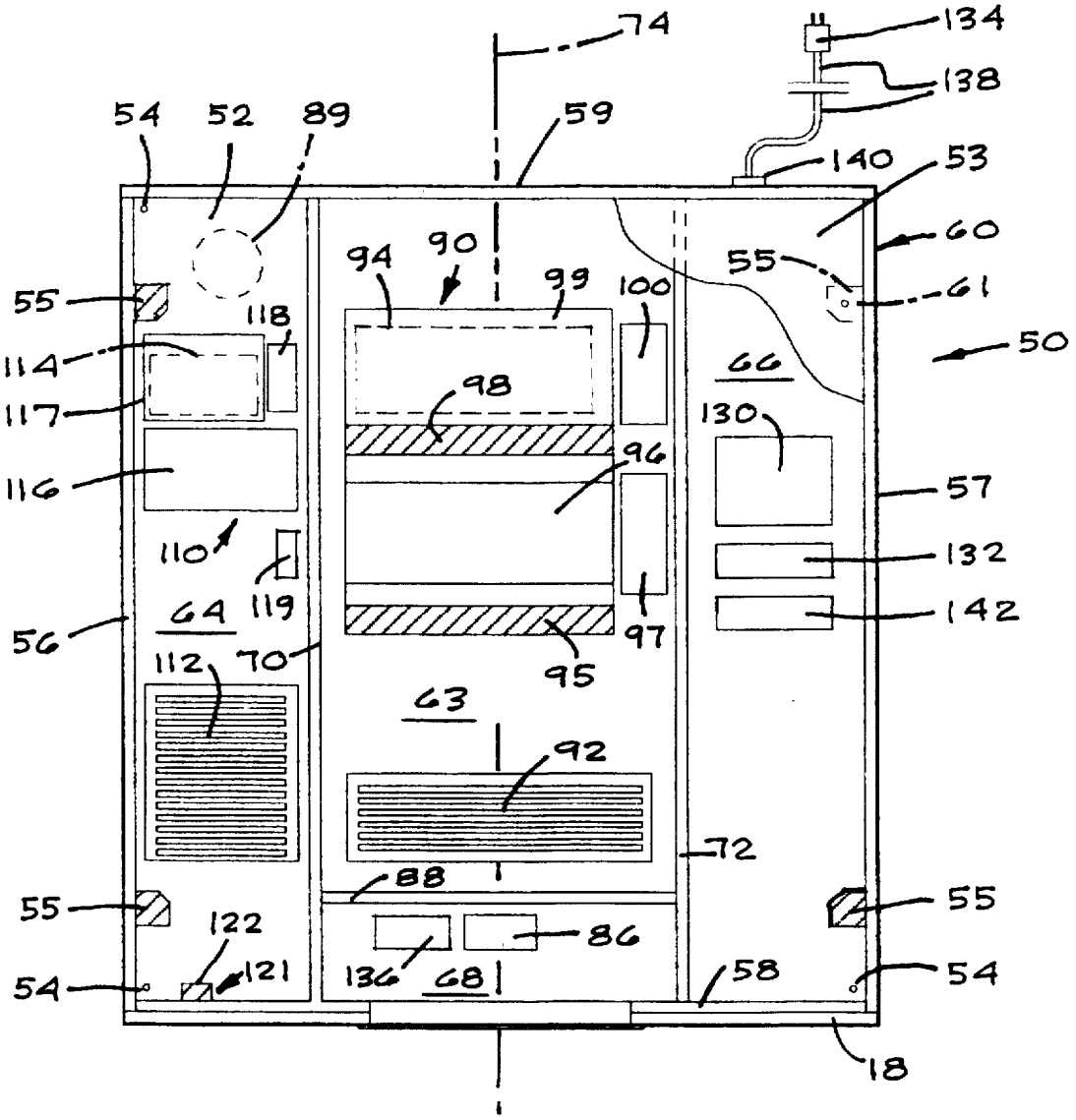
FIG. 5 is an enlarged top view of the booth with its roof panel partially broken away.
Figure 6:
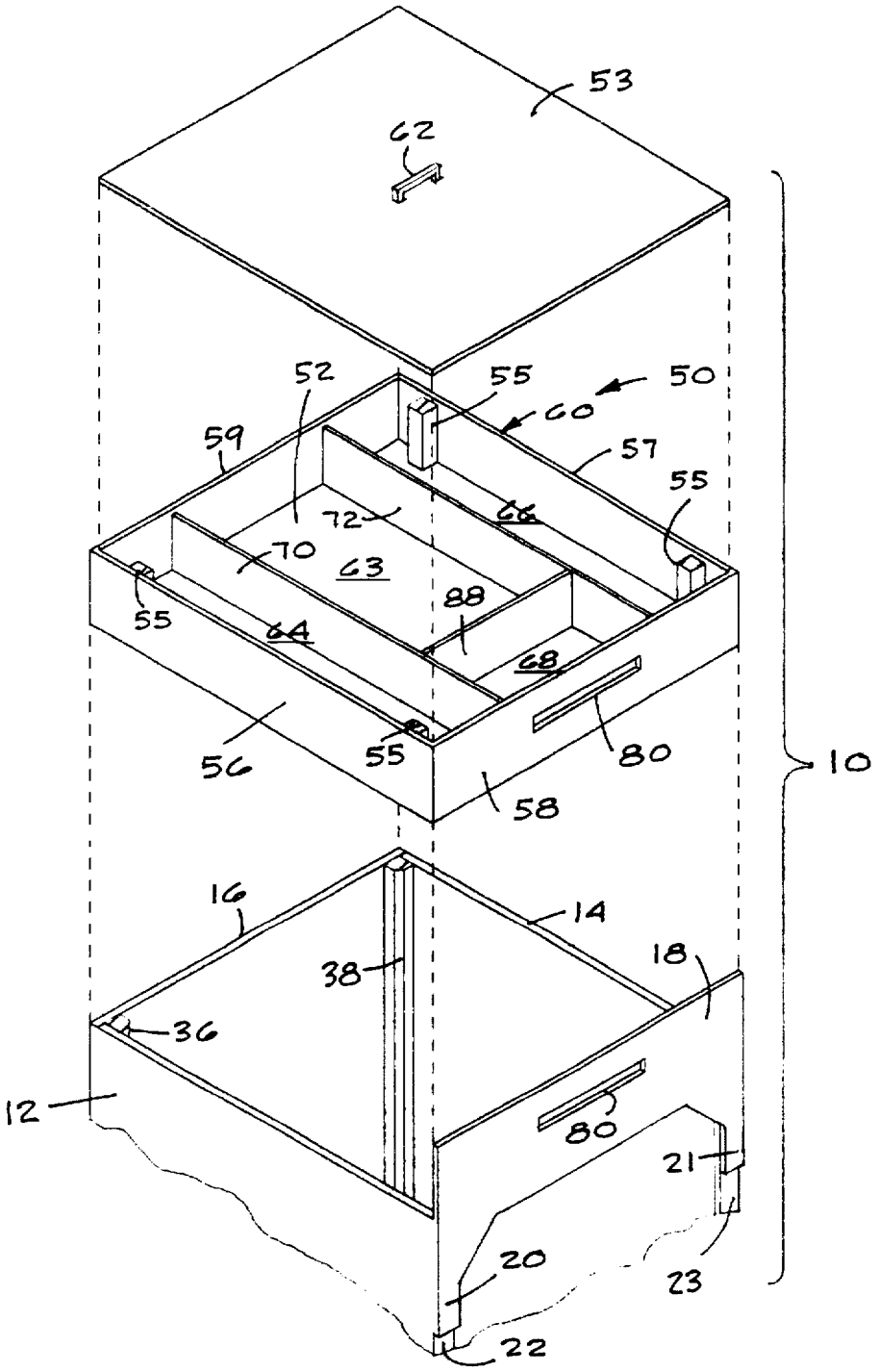
FIG. 6 is a fragmentary, exploded, perspective view of the booth.

As best seen in the exploded view of FIG. 6, a generally box-shaped modular air filtration cap assembly 50, is adapted for enclosing and reinforcing the upper open end of user compartment 51. FIG. 4 shows the modular cap assembly 50, made from suitable structural material such as hardwood, plywood or the like, including a lower rectangular ceiling panel 52, spaced a predetermined vertical dimension below a rectangular roof panel 53. In the disclosed embodiment, the roof panel 53 is in the form of a removable access panel, as seen in FIG. 6. As seen in FIG. 5, each undersurface corner of the ceiling panel 52 is face secured, as by screw fasteners 54, to the upper end of an associated corner framing pillar.

With reference to FIG. 6, each corner area of the access panel 53 is adapted to seat on an upper end of an associated spacer block 55, supporting the roof panel 53 a predetermined vertical dimension above the ceiling panel 52, defining a box-shaped enclosed modular cap space therebetween. The cap space is enclosed by peripheral wallboard means, including left 56 and right 57 longitudinal wallboards together with front 58 and back 59 transverse wallboards. The cap left and right wallboards 56, 57 are each secured at their opposite vertical end edges by screw fasteners, not shown, to associated opposed left and right ends of the front 58 and back 59 transverse wallboards achieving, with the ceiling 52 and roof 53 panels, a modular closed "torquebox" 60, providing the booth with structural rigidity.

In the preferred embodiment, the roof panel 53 is provided with a lift handle, shown at 62 in FIGS. 4 and 6, allowing the panel 53 to be lifted off, upon its removable four screw fasteners 61 being unscrewed from their associated spacer block 55. It will be noted in FIG. 6 that the left and right pair of spacer blocks 55 are secured to their associated cap right 56 and left 57 wallboards, with each block upper end recessed below the free upper edges of the wallboards. As seen in FIG. 4, the secured access panel 53 seats on the blocks 55 with its upper surface flush with the wallboard upper edges.

As best seen in FIGS. 5 and 6, the modular cap defines a box-shaped enclosure including a first or central longitudinally extending plenum chamber 63, having a second parallel plenum chamber 64 on one left side thereof and a third parallel electric equipment chamber 66 on its opposite right side. A fourth light fixture chamber 68 is provided at the front end of the central plenum chamber 63. The cap enclosure is divided and reinforced by left 70 and right 72 interior partition panels, disposed parallel to left 56 and right 57 cap wall panels. FIG. 5 shows the partition panels 70, 72 symmetrically disposed on either side of a longitudinal axis of symmetry, indicated by dashed construction line 74. It will be observed that the central plenum chamber 63 has a width about twice the width of the left side plenum chamber 64 and right side electrical equipment chamber 66.

Referring to FIG. 4, the facia panel 18 includes an elongated aperture 80, aligned with a matching aperture 82 in the front cap wall panel 58, covered by a translucent sign 84 indicating that the booth is occupied. A low-voltage halogen light fixture 86, i.e. in the range of 12 volts, is shown in the cap chamber 68, supported on the ceiling panel 52, adapted for illuminating the occupancy sign phrase "Please Wait" with the door closed, as seen in FIG. 3. A transverse partition panel 88 divides the light chamber 68 from the central plenum chamber 63. As seen in FIG. 4, a 12 volt halogen interior convenience light fixture 89 is mounted on the undersurface of ceiling panel 53, adjacent the left rear corner of the booth. The light fixture 89, in the preferred embodiment, is identical to the low-voltage halogen light fixture 86.

With reference to FIG. 5, the central plenum chamber 63 includes an electrostatic air filtering unit, schematically indicated generally at 90. In the preferred embodiment of the invention, the unit 90 is an "Electronic Air Cleaner", Model 442501-101, made by Trion, Inc. of Sanford, N.C., 27330. The unit 90 is designed to operate on a 15–20 ampere circuit available, for example, from a residence type general purpose duplex receptacle, wired with 115/230 or 120/208 line voltage.

As seen in FIG. 4, the electrostatic unit 90 is supported on an upper surface of the ceiling panel 52, positioned intermediate plenum air intake vent opening 92 and plenum air return vent opening 94, with both of the vent openings in the ceiling panel. The unit 90 includes an initial air filter 95 for removing particulate from a first current of tobacco smoke-laden air flowing upwardly through the intake vent opening 92 from the subjacent user compartment 51. The particulate filter 95 is followed by a cell charging section 96, consisting of fine conducting wires extending between horizontal parallel metal plates, supplied with residence general-purpose voltage of electrical power by a charging device, shown at 97 in FIG. 5. From the charging section 96 the air current moves through an activated charcoal collecting filter 98 to a centrifugal drum type blower 99, driven by a motor shown at 100 in FIG. 5. The blower 99 operates to return the central plenum chamber 63 filtered first air current to the booth compartment 51, via its exhaust vent opening 94. It will be noted that the electric blower motor 100 in the disclosed embodiment provides low, medium, and high blower speeds adjustments for the compartment.

Referring to FIG. 5, the left side second plenum chamber 64 includes an ionizing air purification unit, schematically indicated generally at 110. In the preferred embodiment of the invention, the ionizing unit 110 is an Ozone unit Model "Bora" 100 PU, made by Alpine Industries, 9199 Central, Blaine, Minn. 55434-3422. The unit 110 is supported on the upper surface of the ceiling panel 52, positioned in the cap plenum chamber 64 intermediate intake air vent opening 112 and return air vent opening 114, both located in the ceiling panel. The unit 110 includes a negative ion generator section 116 through which a second current of tobacco smoke-laden air is drawn upwardly from the booth user compartment 51, through the intake vent opening 112. As the second smoke-laden air current flows through the section 116, charged particles in the form of displaced electrons attach themselves to nearby molecules, which molecules then become negative ions. Such negative ions combine with, or "oxidize", tobacco smoke hydrocarbons in the air current, causing the hydrocarbons to break down into water vapor, carbon dioxide and oxygen.

From the section 116 the second intake air current flows through the second plenum chamber 64 to a fan blower 117 of the ionizing unit, driven by a motor 118. The blower 117 returns the purified second air current to the smoking compartment 51, via its return air vent opening 114, wherein the first and second air currents are mixed in the user compartment.

Figure 12:
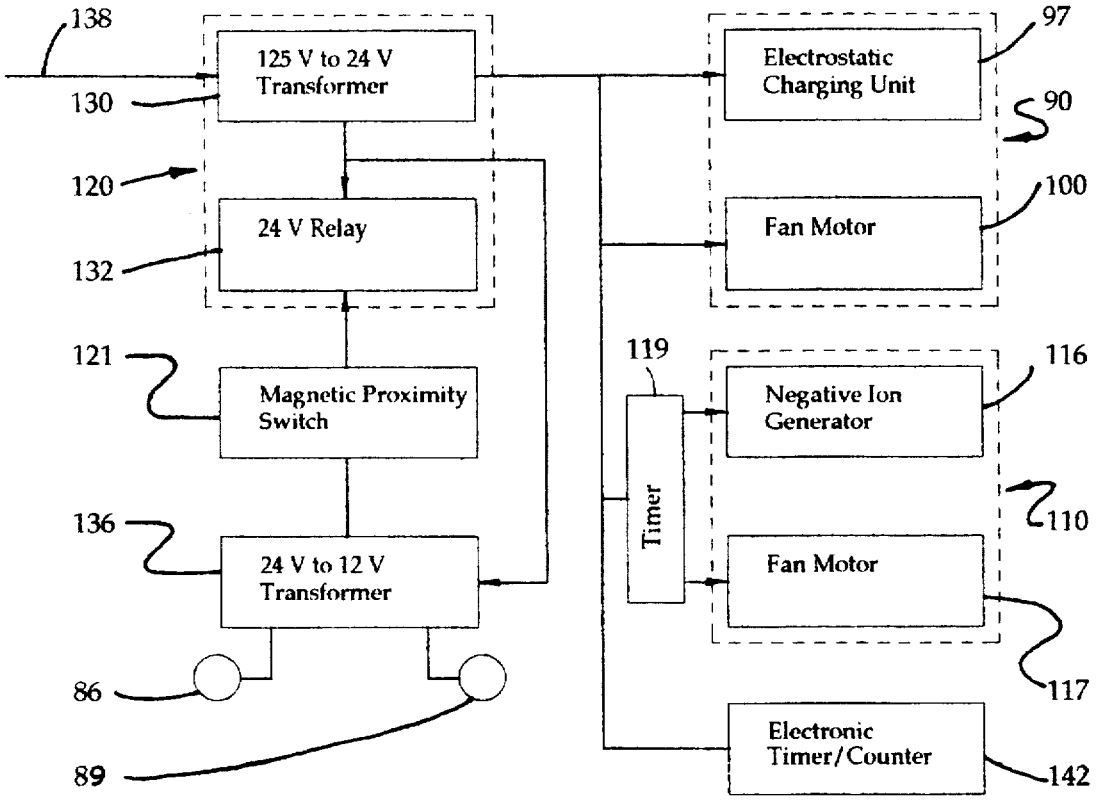
FIG. 12 is a block diagram of the electrical circuit arrangement for the smoker's booth shown in FIGS. 1–6 of the present invention.

Referring to the block diagram of FIG. 12, an electronic delay module or timer 119 is provided for the ionizing unit 110. The timer 119, in conjunction with a booth electrical circuit control unit 120, allows the ionizing unit 110 to continue operating for a predetermined time interval, for example one minute, after the user opens the door 27 and leaves the booth. The additional one minute operation enables the ionizing unit 110 to completely remove any latent smoke odors in the booth. As discussed below, opening the door 72 turns off the unit 90 and the low-voltage light fixtures 86 and 89.

It will be seen in FIG. 3 that a magnetic proximity switch assembly, generally indicated by numeral 121, is arranged between the bifold door 26 and the booth 10. The switch assembly 121 includes a permanent magnet switch member 122, shown in FIG. 4 mounted in a through opening in the booth ceiling panel 92, and a ferrous metal switch armature 124 juxtaposed an upper edge 126 of the bifold door section 28. The magnetic proximity switch assembly 121, in the disclosed embodiment, has a designation "Edwards GS" single-pole, double-throw magnetic switch, manufactured by General Signal Corp., of Farmington, Conn. 08032.

In operation, a user first enters the booth compartment 51 and slides the bifold door sections 28 and 29 to their closed positions, by door handle 32, thereby moving the switch armature 124 into sensing range of the switch permanent magnet, causing the switch 121 to energize step-down line transformer 130. The line transformer supplies low-voltage power to output latching relay 132 of the control unit, thereby closing the output relay 132. The step-down line transformer 130 supplies 120 volts to a line circuit portion of the booth circuit, thereby energizing the air filtration electrostatic charging section 97 and its blower motor 100 together with the negative ion generator 116 and its blower motor 117. At the same time, the line transformer 130 supplies, via a low-voltage circuit portion, 24 volts to a second low-voltage step-down transformer 136 which, in turn, supplies 12 volts to operate the booth interior convenience halogen light fixture 89 and the exterior booth occupancy light fixture 86. It will be noted that line voltage is received by the transformer 130 from a booth grounded plug 134, shown in FIG. 5, adapted for connection to a duplex electrical outlet receptacle, not shown. It will be noted that as all the booth wiring outside of the electrical equipment chamber 66 is low-voltage, there is no danger of shock to users of the booth.

Referring to FIG. 5, it will be seen that line voltage from plug 134 is conducted by electrical cord 138 through cap rear wallboard 59 by metallic conduit 140. The cord 138 is connected by metal conduits and metal boxes, not shown, to the line transformer 130 and the output latching relay 132, housed in the electrical equipment chamber 66. It will be noted that an electronic timer-counter 142 is also installed in the modular cap equipment chamber 66 for recording the length of operating time of the booth air filtration units 90 and 110 for service and maintenance records.

Figure 7:
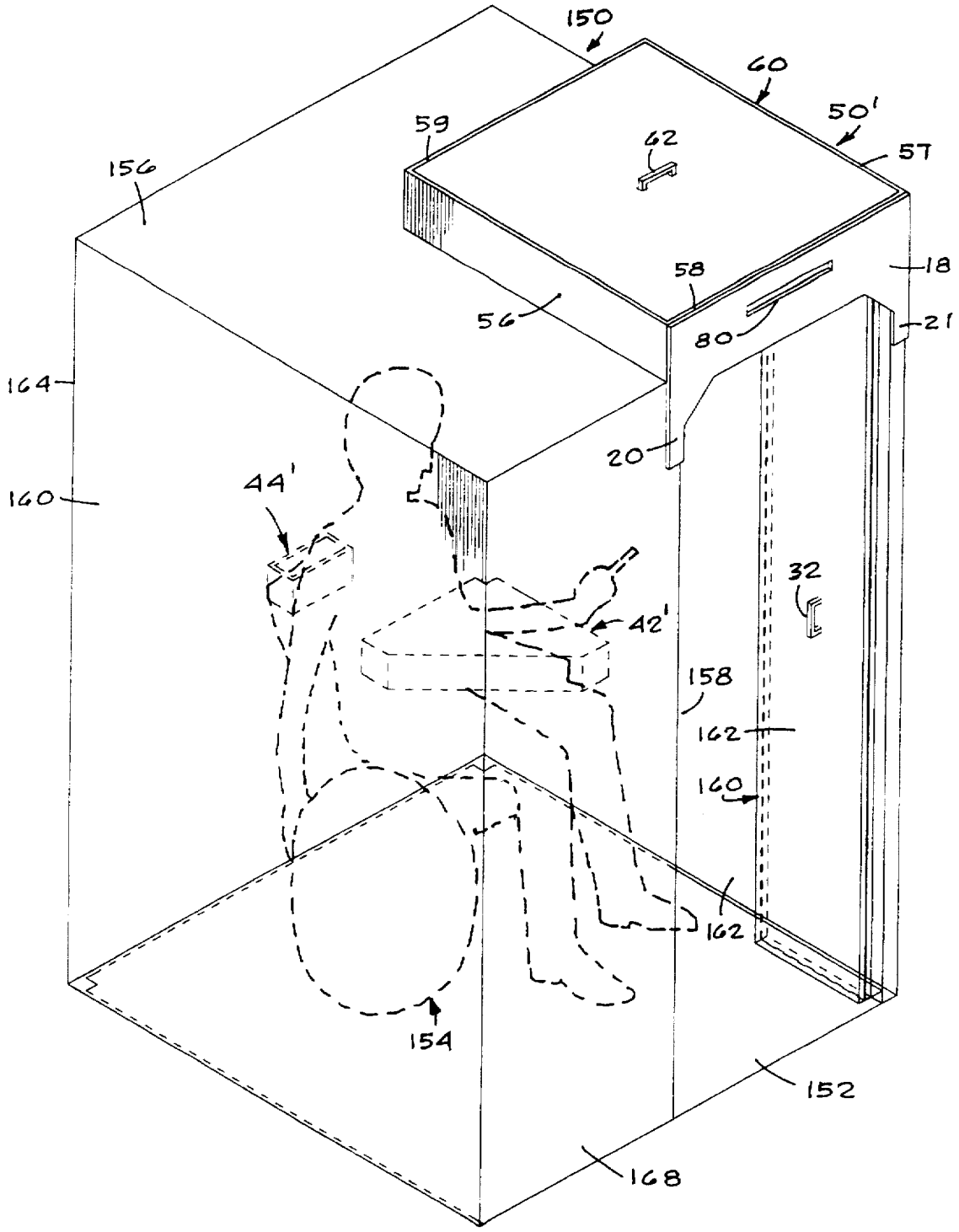
FIG. 7 is a perspective view of a first modified smoker's booth for wheelchair users, incorporating the modular ventilation cap assembly of FIGS. 1–6.

With reference to FIG. 7, a modified smoker's booth, generally indicated at 150, is adapted for wheelchair users. It will be seen that booth base floor panel 152, preferably of waffled aluminum plate, is of the order of five feet square to accommodate a users wheelchair, indicated schematically at 154. A five foot diameter circle, free of obstructions, is a typical dimensional requirement set forth by government agencies to provide adequate turning radius for wheelchairs.

A modular cap assembly 50 is adapted for mounting on roof panel 156 of the booth 150. The roof panel 156 includes a plurality of apertures, not shown, with each aperture aligned with an associated vent opening in the overlying ceiling panel of the modular cap assembly 50. The booth left 160 and right 162 sidewall panels, back sidewall panel 164, and front sidewall 166, together with the base panel 152 and roof panel 156, are adapted to be readily assembled and disassembled, as by removable mounting clips or the like, to provide a "knock-down" portable assembly. As the doorway 158 must provide a clear minimum width of the order of two feet-ten inches, a larger bifold door 160, provided with wider panel sections 162, is required to close doorway 158.

Figure 8:
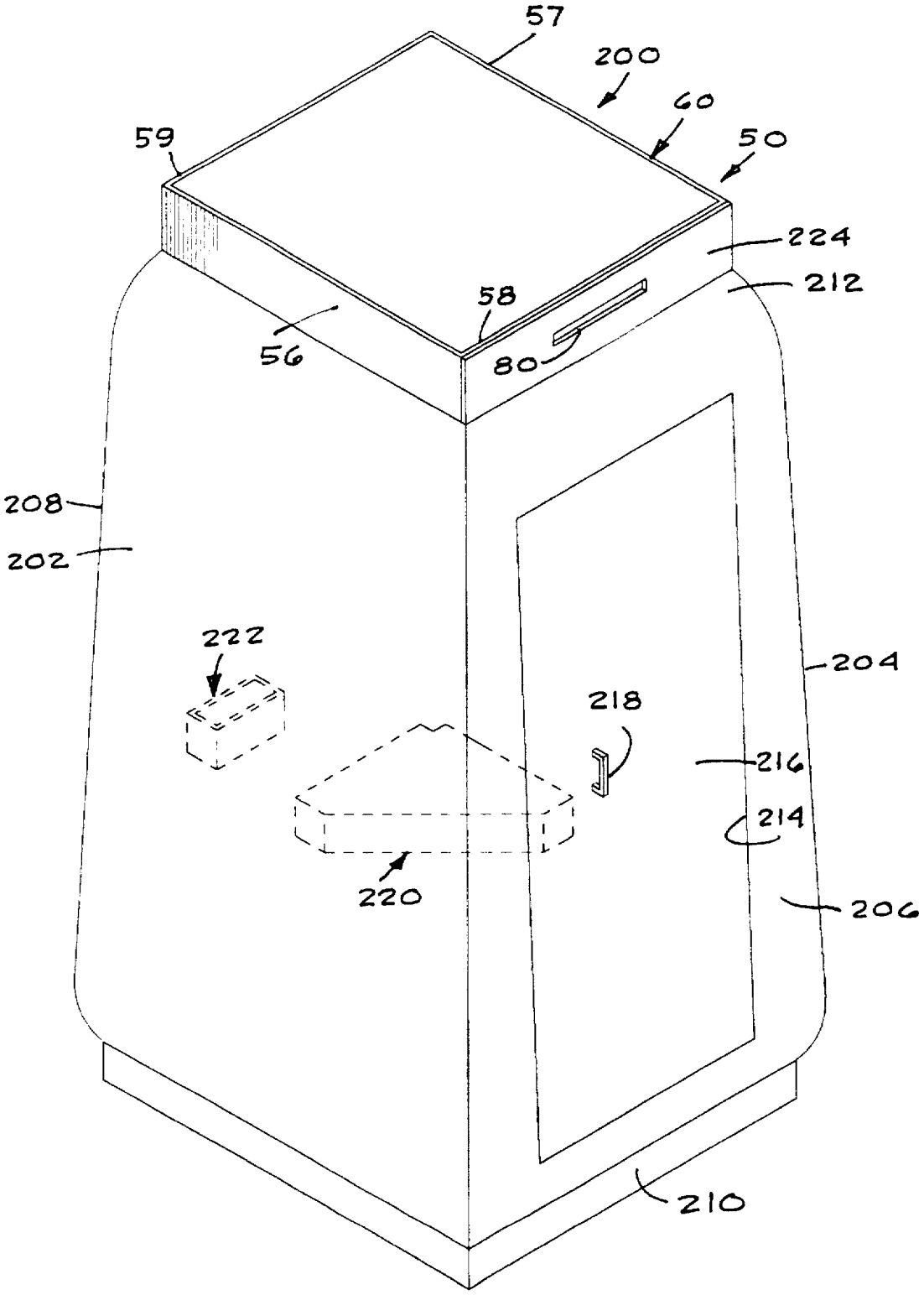
FIG. 8 is a perspective view of a second modified smoker's booth, fabricated from molded structural plastic for industrial locations, incorporating the modular ventilation cap assembly of FIGS. 1–6.

Referring to FIG. 8, a second modified smoker's booth, generally indicated at 200, is designed for use in industrial settings. The portable, free-standing booth 200 has its right 202 and left 204 sidewalls, front sidewall 206, back sidewall 208, base 210, and upper panel 212 integrally molded of structural plastic material. A front doorway 214 is closed by a single door 216 having a door handle 218 mounted on the exterior side of the door. The booth compartment includes a user corner seat 220 and wall mounted ashtray 222. The modular filtration cap assembly 50 is shown mounted on the booth upper panel 212. The upper panel 212 includes a plurality of apertures, not shown, with each aperture adapted for alignment with an associated vent opening in the ceiling panel, not shown, of the modular filtration cap assembly 50. It will be noted that a modified rectangular shaped front facia panel 224 is provided for the assembly 50.

Figure 9:
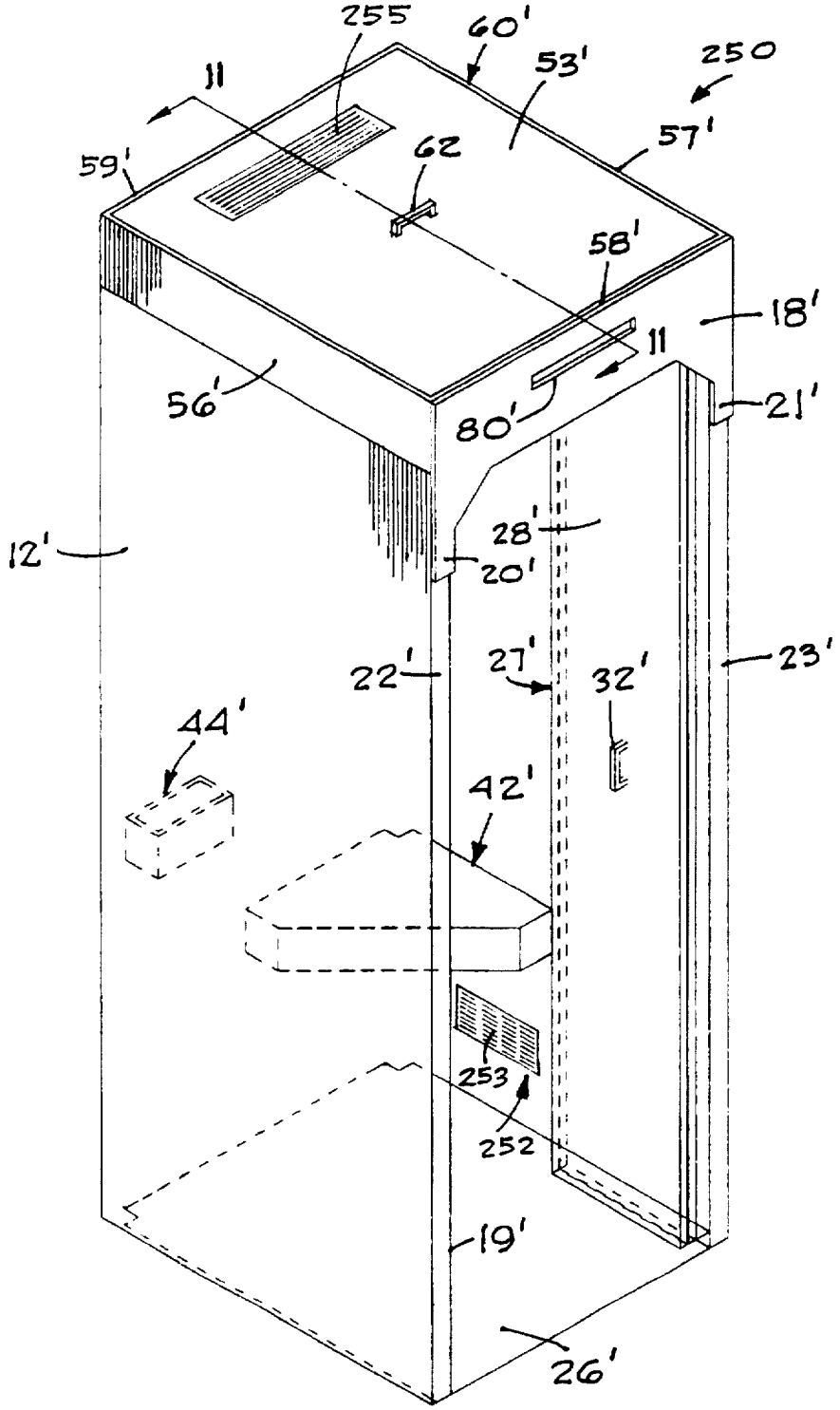
FIG. 9 is a perspective view, similar to FIG. 1, showing a second embodiment of the smoker's booth, wherein an ambient air intake vent is provided in the right side wall of the booth, and an air exhaust vent is provided in the roof panel of the booth.
Figure 10:
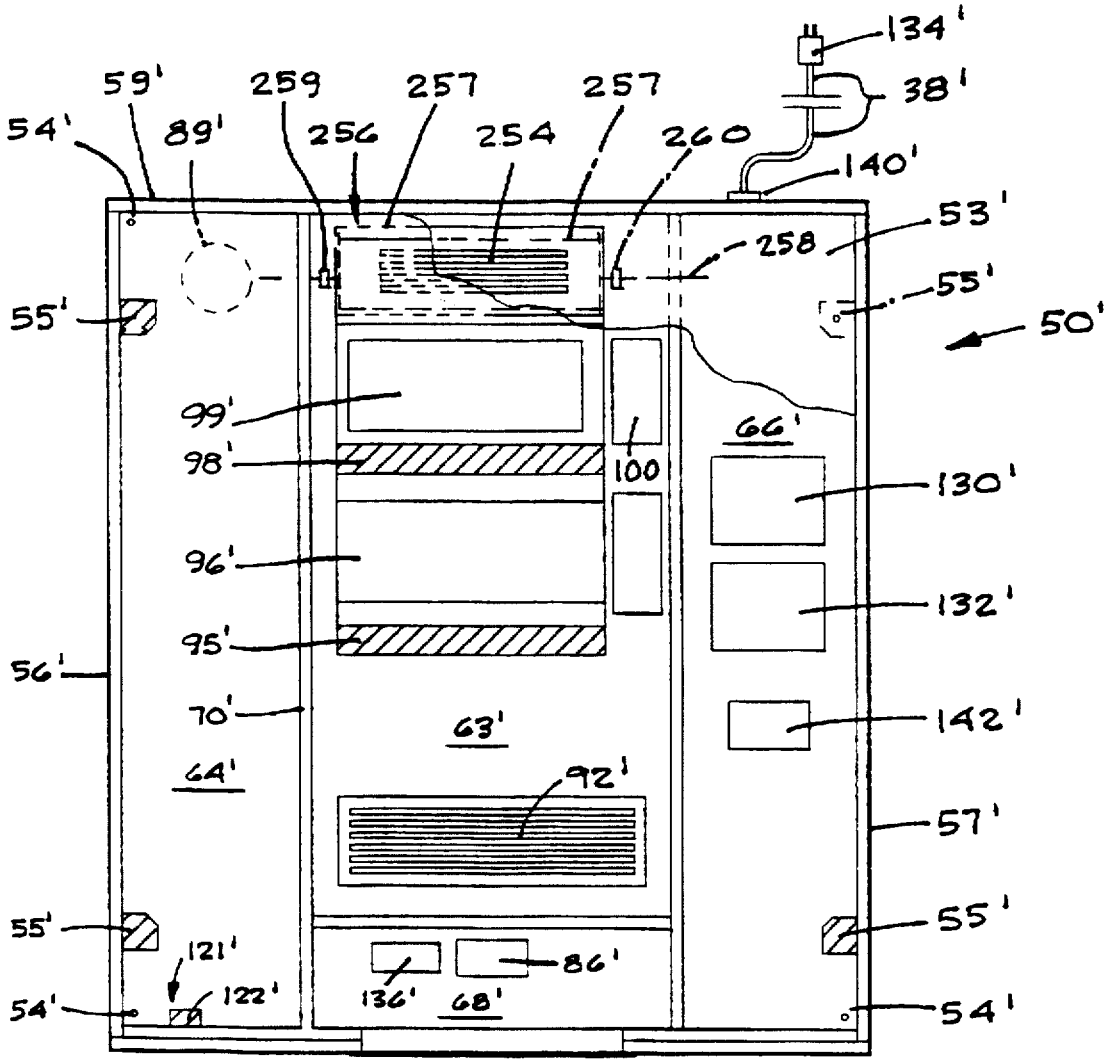
FIG. 10 is a cross sectional view, similar to FIG. 5, showing the modular air filtration cap assembly of the FIG. 9 embodiment.
Figure 11:
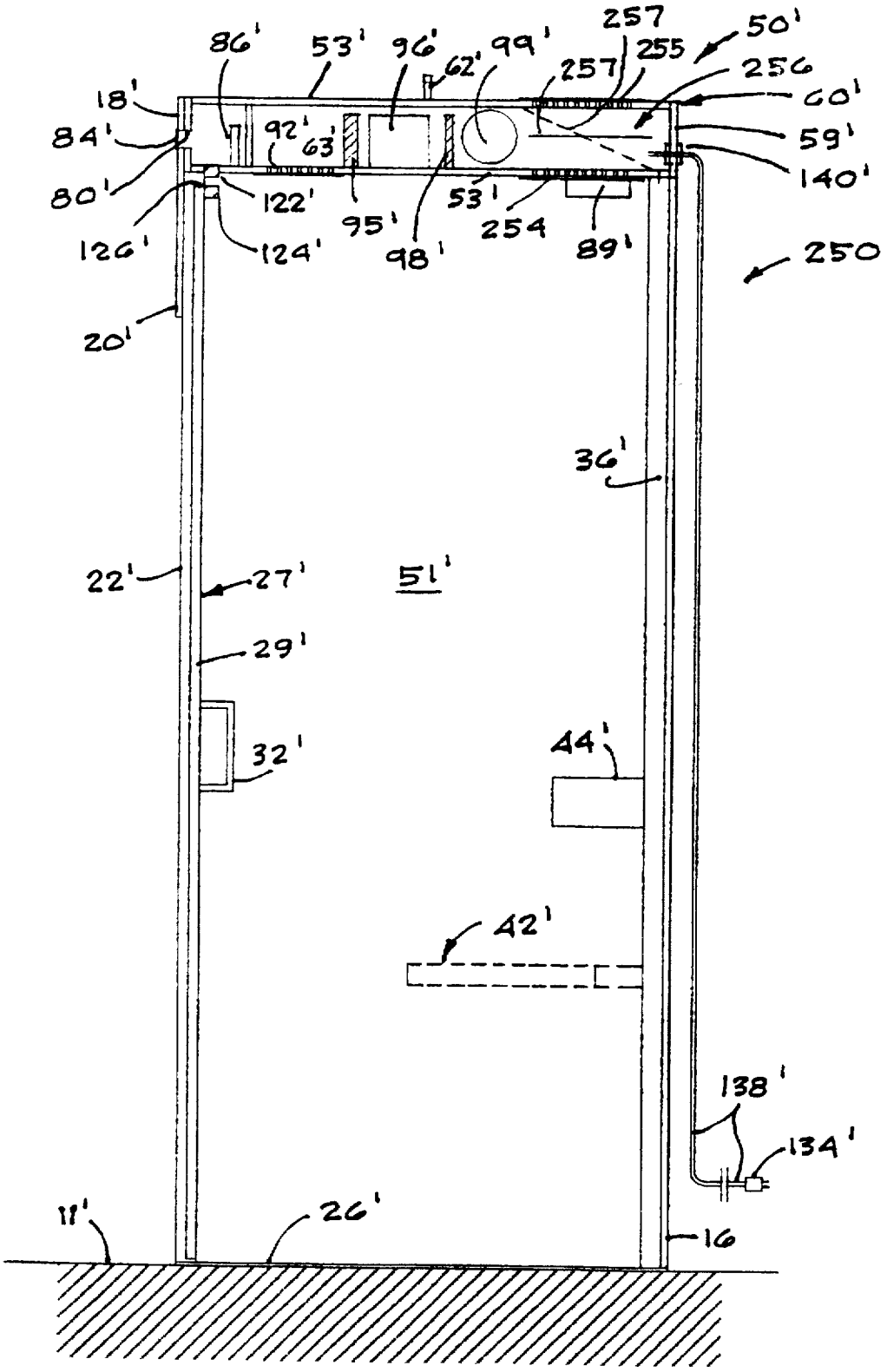
FIG. 11 is a vertical cross sectional view, taken substantially on the line 11—11 of FIG. 9, with the bifold door shown in its closed position.

With reference to FIGS. 9, 10, and 11, a second embodiment of the smoker's booth is generally indicated by the numeral 250. In the description of FIGS. 9–11, the same or substantially identical elements as shown in the booth of FIGS. 1–6 and 12 will be identified with the same reference numerals, with the exception being that such reference numerals are primed. FIG. 9 shows an ambient air intake louver 252, having slatlike grill opening 253, located in the smoker's compartment 51 of the booth beneath the user's seat 42'.

Referring to FIG. 11, it will be seen that a center plenum chamber 63' is provided with a return air vent opening 254 in the ceiling panel 53', located between blower 99' and the rear wallboard 59'. As best seen in FIG. 9, an exhaust air vent opening 255 is located in the roof access panel 53', in communication with ambient air of a surrounding enclosed area, such as a room, building lobby, industrial plant, or the like.

FIGS. 10 and 11 show an adjustable damper assembly 256, including a rectangular plate 257 suitably supported, at the aft end of the plenum chamber 63', for pivotal rotation about a transverse axis 258. The damper assembly includes left 259 and right 260 opposite manual controls for indexing the plate to a plurality of rotated settings. In FIG. 11, the damper plate 257 is shown rotated to a solid line, horizontal position, wherein the plenum filtered air flow is divided into a first fifty percent (50%) air current exhausted to ambient and a second fifty percent (50%) air current returned to the booth compartment 51'. The damper plate 257 is also shown rotated clockwise to a dashed line, angled position, wherein one hundred percent (100%) of the plenum filtered air flow is returned to the booth compartment 51' and zero percent (0%) is exhausted the ambient. It will be noted that if the damper plate 257 were rotated counter-clockwise to a symmetrically opposite angled position, one hundred percent (100%) of the plenum filtered air would be exhausted to ambient and zero percent (0%) would be returned to the booth compartment. Further, the damper plate 257 is adapted to be rotatably indexed to any desired angular position by the controls 259 and 260 to divide the plenum filtered air flow between the exhaust vent opening 255 and the return vent opening 254.

The damper arrangement 258 is adapted for adjustment to control the amount of filtered air flow returned to the booth compartment 51' and the amount of filtered air flow exhausted to the ambient air exterior of the booth. The damper 256 is adapted for dividing the filtered air flow of plenum 63' into two air currents, wherein the greater the current of filtered air exhausted out the vent 255 to the ambient, the smaller the current of filtered air recirculated to the compartment through the return air vent opening 254, and thus the greater the amount of fresh ambient make-up air pulled into the compartment through the ambient air intake louver 252 to replace the air being exhausted from the plenum exhaust vent 255.

Although the invention has been described by reference to certain specific embodiments, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A free-standing smoker's booth for use within an enclosed area comprising:

a booth enclosure defined by sidewall means upstanding from base panel means, said sidewall means provided with a doorway closed by door means, said booth enclosure having a lower end closed by said base panel means and an upper end closed by cap means;

said booth enclosure divided by barrier panel means into a user compartment and a closed space, means in said closed space defining first and second plenum chambers, said first chamber enclosing a first air treating means, a first blower, a first intake air vent opening means, and a first return air vent opening means, said first blower intermediate said first intake air vent opening means and said first return air vent opening means, said second chamber enclosing a second air treating means, a second blower, a second intake air vent opening means, and a second return air vent opening means, said second blower intermediate said second intake air vent opening means and said second return air vent opening means, each of said opening means in communication with said compartment, said first blower means adapted for directing a flow of tobacco smoke-laden air from said user compartment, through said first intake air vent opening means and said first air treating means, wherein the treated air flow is circulated by the first blower means through the first plenum chamber and said first return vent opening means back to the compartment, said second blower means adapted for directing a flow of tobacco smoke-laden air from said user compartment, through said second intake air vent opening means and said second air treating means, wherein the treated air flow is circulated by the second blower means through the second plenum chamber and said second return vent opening means back to said compartment, the first and second air treating means being of diverse types to perform differing beneficial treatments on the air, thereby obviating ambient air entering said booth or smoke-laden air being exhausted from said booth during operation of said booth air treating and blower means.

2. The smoker's booth as set forth in claim 1 wherein said compartment is sized and configured for accommodating only one person at a time.

3. The smoker's booth as set forth in claim 1 wherein said booth is rectangular in horizontal section, having a width dimension less than three-feet and a length dimension of about three feet, thereby allowing the booth to be transported through three-foot wide room entrances and doorways.

4. The smoker's booth as set forth in claim 3 wherein said booth has a height dimension of about seven feet, thereby allowing the booth to be positioned upright in rooms having a minimum ceiling height dimension about of eight-feet.

5. The smoker's booth as set forth in claim 1 wherein said first air treating means includes electrostatic air filtration means and said second air treating means includes ionizing air purification means.

6. The smoker's booth as set forth in claim 1 wherein said cap means is in the form of a modular cap assembly comprising a ceiling panel defining said barrier panel means and having peripheral wallboard means upstanding therefrom, said wallboard means supporting an overlying roof panel defining, with said ceiling panel and said wallboard means, said closed space, and partition means upstanding from said ceiling panel which, together with said wallboard means, divides said closed space into said first and second plenum chambers.

7. The smoker's booth as set forth in claim 6 wherein said first air treating means includes air filtration means supported on said ceiling panel intermediate said first intake and return air vent opening means and said second air treating means includes ionizing air purification means supported on said ceiling panel intermediate said second intake and return air vent opening means, each of said intake and return air vent opening means being located in said ceiling panel.

8. The smoker's booth as set forth in claim 6 wherein said modular cap assembly comprises a rectangular box-shaped modular cap structure including left and right longitudinal wallboards, each having opposite front and back ends and inner faces, and front and back transverse wallboards having left and right ends and inner faces, each of the ends of the longitudinal wallboards secured to associated opposite left and right ends of said front and back transverse wallboards, forming a rectangular cap frame, said cap frame having an open bottom closed by said ceiling panel and an open top closed by said roof panel, and wherein said partition means is in the form of a plurality of parallel partition members, each partition member having respective opposite edges secured to associated inner faces of opposed wallboards, said ceiling panel having corners, each with an adjacent undersurface portion, one of four upright framing corner posts supporting the sidewall means of said booth, said corners of the ceiling panel secured to one of the corner posts, said modular cap structure forming a torque-box providing said sidewall means and corner framing posts with high structural rigidity.

9. The smoker's booth as set forth in claim 6 wherein said roof panel is in the form of an access panel adapted for removable attachment on said peripheral wallboard means whereby, upon said access panel being removed, said chambers are open for servicing and maintenance of air filtration and electrical equipment located therein.

10. The smoker's booth as set forth in claim 1 wherein said compartment door means is in the form of an inwardly folding bifold door.

11. The smoker's booth as set forth in claim 1 wherein said booth has a rectangular shape in horizontal section, said booth including four upright rectangular corner framing posts, said base panel means having corners, the framing posts upstanding from the corners of the base panel means, each said corner post having a lower end secured to said base panel means, said booth being enclosed by right, left, and back sidewall panel means, each said sidewall panel has an interior surface portion secured adjacent a pair of said posts, and an upper front facia panel having an interior surface portion secured to said pair of posts, whereby said pair of posts and said upper facia panel define a booth front doorway adapted to be closed by said door means.

12. The smoker's booth as set forth in claim 1 wherein said sidewall means enclose an enlarged wheelchair accommodating booth, said enlarged booth comprising user compartment floor means providing a wheelchair turning area defined by a circle, free of obstruction, having a diameter of about five feet, and a doorway having a width of at least 2 feet, 10 inches.

13. The smoker's booth as set forth in claim 12 wherein said sidewall means is in the form of a portable wall assembly comprising a plurality of sidewall panels adapted for support by at least four pillars mounted upright on said floor means, and connecting means for releasably attaching selected ones of said panels to associated pillars, said enlarged booth having a "knock-down" disassembled mode, allowing said enlarged booth to be transported through a doorway having a width dimension of at least three-feet.

14. The smoker's booth as set forth in claim 1 wherein said sidewall means is in the form of a one-piece plastic structure, providing a doorway closed by door means and defining an enclosed user's compartment sized and configured for use by one smoker at a time, said plastic structure having apertured ceiling means adapted for removably supporting a modular cap assembly, said cap assembly defining said closed space and said first and second plenum chambers enclosing said first and second air treating and blower means intermediate said first and second intake air vent opening means and said first and second return air vent opening means respectively.

15. A free-standing smoker's booth for use within an enclosed area comprising:

a booth enclosure defined by sidewall means upstanding from base panel means, said sidewall means provided with a doorway closed by door means, said booth enclosure having a lower end closed by said base panel means and an upper end closed by cap means;

said booth enclosure divided by barrier panel means into a user compartment and a closed space, said closed space defining at least one plenum chamber enclosing air treating means, intake air vent opening means, return air vent opening means, and means, intake air vent opening means, return air vent opening means, blower means, said blower means intermediate said intake air vent opening means and return air vent opening means, with each said opening means in communication with said compartment, said blower means adapted for directing a flow of tobacco smoke-laden air from said user compartment, through said plenum chamber intake air vent opening means and said air treating means;

ambient air intake louver opening means in said compartment sidewall means and exhaust air vent opening means in said plenum chamber, and adjustable damper means, positioned in said plenum chamber intermediate said exhaust and return air vent opening means for controlling treated air flow thereto; wherein with said damper means adjusted to a full exhaust setting, one hundred percent of the plenum chamber treated air flow is exhausted to the ambient, through said plenum chamber exhaust air vent opening means, and an amount of ambient air, equal to the amount of plenum chamber treated air exhausted to the ambient, is drawn into said compartment through said compartment ambient air intake louver opening means;

with said damper means adjusted to a full return setting, one hundred percent of the plenum chamber treated air flow is returned, through said return air vent means, to said compartment; and with said damper means adjusted to one of a plurality of divided treated air flow settings, a selected percentage of the plenum chamber treated air flow is exhausted to the ambient through said air vent opening means and the remaining plenum chamber air flow is returned, through said plenum chamber return air vent opening means, to said compartment, and an amount of ambient air, equal to the percentage of treated air exhausted to the ambient through said exhaust air vent opening means, is drawn into said compartment through said compartment intake louver opening means.

16. The smoker's booth as set forth in claim 15 wherein said compartment is sized and configured for accommodating only one person at a time.

17. The smoker's booth as set forth in claim 15 wherein said booth is rectangular in horizontal section, having a width dimension less than three feet and a length dimension of about three feet.

18. The smoker's booth as set forth in claim 15 wherein said booth has a height dimension of about seven feet, thereby allowing the booth to be positioned upright in enclosures having a minimum ceiling height dimension of about eight feet.

19. The smoker's booth as set forth in claim 15 wherein said air filtration means is in the form of electrostatic air filtration means.

20. The smoker's booth as set forth in claim 19 wherein said cap means defines the closed space providing said plenum chamber, said blower means is intermediate said electrostatic air filtration means and said adjustable damper means, wherein said blower means is adapted for directing the flow of tobacco smoke-laden air upwardly from said compartment through said plenum chamber intake air vent opening means and then directing said flow horizontally through said electrostatic air filtration means.

21. The smoker's booth as set forth in claim 15 wherein said cap means is in the form of a modular cap assembly comprising a cap structure having a ceiling panel supporting peripheral wallboard means upstanding therefrom, said wallboard means supporting an overlying roof panel which, together with partition means, divides said cap space into a plurality of closed chambers, wherein one of said chambers defines said plenum chamber.

22. The smoker's booth as set forth in claim 21 wherein said air treating means is supported on said ceiling panel intermediate said intake and return air vent opening means located in said ceiling panel, and wherein said return vent opening means is located in said roof panel in vertical aligned overlying relation with said return vent opening means.

23. The smoker's booth as set forth in claim 21 wherein said booth is rectangular in horizontal section, having a width dimension less than three feet and a length dimension of about three feet, and wherein said modular cap structure is defined by a rectangular box-shaped modular cap structure comprising left and right longitudinal wallboards, and front and back transverse wallboards, the longitudinal wallboards secured at their ends to associated ends of the front and back transverse wallboards forming a rectangular cap frame, said frame having an open bottom and an open top closed by ceiling panel and roof panel, respectively, and wherein said partition means comprise a plurality of longitudinal partition members, each having opposite vertical edges secured to associated inner faces of opposed transverse front and back wallboards, said modular cap structure ceiling panel having four corner portions said four upright framing corner posts, each of the corner portions secured to an associated corner post said modular cap structure forming a torque-box providing, together with said sidewall means and said base panel means fixed to said four posts, a booth with high structural rigidity.

24. The smoker's booth as set forth in claim 21 wherein said roof panel is in the form of an access panel adapted for ready removable attachment on said peripheral wallboard means whereby, upon said access panel being removed, said at least one chamber is opened for ready servicing and maintenance of said air treatment means, located in said plenum chambers.

25. A method of treating tobacco smoke-laden air in a smoker's booth located in an enclosed area comprising:

drawing a smoker's tobacco smoke-laden air flow upwardly, from a closed booth compartment, into first and second booth plenum chambers;

separating the air flow by flowing a first compartment air current through an electrostatic air filtration unit in said first plenum chamber, and conjointly flowing a second compartment air current through an ionizing air purification unit in said second plenum chamber; and returning said first and second treated air currents downwardly from their associated first and second plenum chambers for mixing with tobacco smoke-laden air in said compartment, whereby the mixed smoke-laden air and treated air is circulated upwardly through said first and second plenum chambers.

26. The method of treating tobacco smoke-laden air as set forth in claim 25 herein said second plenum chamber ionizing air unit continues to operate a predetermined time interval after said first plenum chamber electrostatic air unit ceases to operate, caused by the smoker opening the door of said compartment, whereby said ionizing air unit removes tobacco smoke odors from the open booth compartment.

27. A method of treating tobacco smoke-laden air in a smoker's booth located in an enclosed area comprising:

drawing a tobacco smoke-laden air flow from a smoker upwardly, from a closed booth compartment, into a booth plenum chamber;

passing the tobacco smoke-laden air flow through an electrostatic air filtration unit in said plenum chamber;

exhausting a portion of the filtered air flow to the ambient air and returning the remaining portion of the filtered air flow to the compartment;

drawing into the compartment an amount of make-up ambient air substantially equal to the selected amount of filtered air exhausted to the ambient from the plenum chamber; and mixing said returned filtered air and said selected make-up air in said compartment, with tobacco smoke-laden air in the compartment, whereby said mixed smoke-laden air, returned filtered air and said selected make-up air, circulated upwardly through said plenum chamber.

* * * * *